US008417152B2

(12) United States Patent
Takeyama et al.

(10) Patent No.: US 8,417,152 B2
(45) Date of Patent: Apr. 9, 2013

(54) PROCESS CARTRIDGE AND IMAGE FORMING APPARATUS

(75) Inventors: Yoshifumi Takeyama, Mishima (JP); Tetsuya Numata, Suntou-gun (JP); Shigeo Miyabe, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 575 days.

(21) Appl. No.: 12/544,598

(22) Filed: Aug. 20, 2009

(65) Prior Publication Data

US 2010/0054807 A1 Mar. 4, 2010

(30) Foreign Application Priority Data

Sep. 1, 2008 (JP) ..... 2008-223402
Jul. 14, 2009 (JP) ..... 2009-165611

(51) Int. Cl.
*G03G 15/20* (2006.01)
*G03G 15/08* (2006.01)

(52) U.S. Cl. ..... 399/123; 399/102

(58) Field of Classification Search ..... 399/102, 399/123, 358, 360

See application file for complete search history.

(56) References Cited

U.S. PATENT DOCUMENTS

| | | | | |
|---|---|---|---|---|
| 4,530,594 A | | 7/1985 | Adachi | 355/15 |
| 5,331,373 A | | 7/1994 | Nomura et al. | 355/200 |
| 5,452,056 A | | 9/1995 | Nomura et al. | 355/200 |
| 5,463,446 A | | 10/1995 | Watanabe et al. | 355/200 |
| 5,585,889 A | | 12/1996 | Shishido et al. | 355/200 |
| 5,640,650 A | | 6/1997 | Watanabe et al. | 399/117 |
| 5,655,178 A | * | 8/1997 | Ishikawa et al. | 399/102 |
| 5,697,022 A | * | 12/1997 | Matsuda et al. | 399/102 |
| 5,809,374 A | * | 9/1998 | Tsuda et al. | 399/111 |
| 5,839,028 A | | 11/1998 | Nomura et al. | 399/109 |
| 5,873,012 A | | 2/1999 | Miyabe et al. | 399/90 |
| 5,878,309 A | | 3/1999 | Nomura et al. | 399/111 |

(Continued)

FOREIGN PATENT DOCUMENTS

| | | |
|---|---|---|
| JP | 58-203479 | 11/1983 |
| JP | 5-53384 | 3/1993 |

(Continued)

OTHER PUBLICATIONS

Machine translation of reference Karakama et al. (JP Pub No. 05-053,384 A), Listed in IDS, Pub date Mar. 5, 1993.*

(Continued)

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

A process cartridge is detachably mountable to a main assembly of an image forming apparatus. The process cartridge includes an image bearing member, a cleaning member for removing a developer from the image bearing member, a frame provided with an opening, and a developer accommodating portion for accommodating the developer which was removed by the cleaning member and passed through the opening. A sheet member is also provided, contacting the image bearing member, for preventing the developer from leaking out of the developer accommodating portion. A supporting portion is provided to the frame, for supporting the sheet member. A reinforcing portion, provided to the frame, connecting one end side portion of the frame located upstream of the opening with the other end side portion of the frame located downstream of the opening, with respect to a rotational direction of the image bearing member.

12 Claims, 13 Drawing Sheets

U.S. PATENT DOCUMENTS

| | | | | |
|---|---|---|---|---|
| 5,878,310 | A | 3/1999 | Noda et al. | 399/117 |
| 5,884,124 | A * | 3/1999 | Karakama et al. | 399/123 |
| 5,899,602 | A | 5/1999 | Noda et al. | 399/111 |
| 5,926,666 | A | 7/1999 | Miura et al. | 399/25 |
| 5,943,528 | A | 8/1999 | Akutsu et al. | 399/110 |
| 5,943,529 | A | 8/1999 | Miyabe et al. | 399/111 |
| 5,946,531 | A | 8/1999 | Miura et al. | 399/111 |
| 5,950,047 | A | 9/1999 | Miyabe et al. | 399/111 |
| 5,966,567 | A | 10/1999 | Matsuzaki et al. | 399/111 |
| 6,029,031 | A | 2/2000 | Yokomori et al. | 399/109 |
| 6,064,843 | A | 5/2000 | Isobe et al. | 399/111 |
| 6,072,968 | A | 6/2000 | Nomura et al. | 399/113 |
| 6,128,452 | A | 10/2000 | Miyabe et al. | 399/90 |
| 6,154,623 | A | 11/2000 | Suzuki et al. | 399/111 |
| 6,167,219 | A | 12/2000 | Miyamoto et al. | 399/90 |
| 6,173,140 | B1 | 1/2001 | Suzuki et al. | 399/113 |
| 6,215,969 | B1 | 4/2001 | Nomura et al. | 399/111 |
| 6,282,390 | B1 | 8/2001 | Miyabe et al. | 399/111 |
| 6,317,572 | B1 | 11/2001 | Miyabe et al. | 399/111 |
| 6,336,017 | B1 | 1/2002 | Miyamoto et al. | 399/116 |
| 6,351,620 | B1 | 2/2002 | Miyabe et al. | 399/111 |
| 6,415,121 | B1 | 7/2002 | Suzuki et al. | 399/111 |
| 6,519,431 | B1 | 2/2003 | Toba et al. | 399/111 |
| 6,542,706 | B2 | 4/2003 | Toba et al. | 399/111 |
| 6,549,736 | B2 | 4/2003 | Miyabe et al. | 399/111 |
| 6,603,939 | B1 | 8/2003 | Toba et al. | 399/103 |
| 6,678,488 | B2 | 1/2004 | Toba et al. | 399/111 |
| 6,795,666 | B2 | 9/2004 | Miyabe et al. | 399/109 |
| 6,836,629 | B2 | 12/2004 | Miyabe et al. | 399/111 |
| 6,931,226 | B2 | 8/2005 | Chadani et al. | 399/109 |
| 6,934,485 | B2 | 8/2005 | Miyabe et al. | 399/90 |
| 7,024,134 | B2 | 4/2006 | Yokomori et al. | 399/111 |
| 7,136,604 | B2 | 11/2006 | Chadani et al. | 399/90 |
| 7,149,457 | B2 | 12/2006 | Miyabe et al. | 399/114 |
| 7,155,141 | B2 | 12/2006 | Sato et al. | 399/114 |
| 7,158,736 | B2 | 1/2007 | Sato et al. | 399/111 |
| 7,164,875 | B2 | 1/2007 | Miyabe et al. | 399/111 |
| 7,184,690 | B2 | 2/2007 | Ueno et al. | 399/117 |
| 7,212,768 | B2 | 5/2007 | Numagami et al. | 399/111 |
| 7,224,925 | B2 | 5/2007 | Sato et al. | 399/263 |
| 7,248,810 | B2 | 7/2007 | Miyabe et al. | 399/90 |
| 7,315,710 | B2 | 1/2008 | Ueno et al. | 399/117 |
| 7,349,657 | B2 | 3/2008 | Sato et al. | 399/263 |
| 7,412,193 | B2 | 8/2008 | Sato et al. | 399/263 |
| 7,450,877 | B2 | 11/2008 | Miyabe et al. | 399/90 |
| 7,499,663 | B2 | 3/2009 | Sato et al. | 399/106 |
| 2005/0019059 | A1 | 1/2005 | Yokomori et al. | 399/111 |
| 2008/0152388 | A1 | 6/2008 | Ueno et al. | 399/167 |
| 2008/0260428 | A1 | 10/2008 | Ueno et al. | 399/167 |
| 2008/0286000 | A1 | 11/2008 | Kimizuka et al. | 399/111 |
| 2008/0286004 | A1 | 11/2008 | Kimizuka et al. | 399/119 |
| 2009/0047037 | A1 | 2/2009 | Miyabe et al. | 399/111 |
| 2009/0074454 | A1 | 3/2009 | Sato et al. | 399/113 |

FOREIGN PATENT DOCUMENTS

| | | |
|---|---|---|
| JP | 7-175393 | 7/1995 |
| JP | 8-220970 | 8/1996 |
| JP | 8-272239 | 10/1996 |
| JP | 8-339148 | 12/1996 |
| JP | 2000-172142 | 6/2000 |
| JP | 2002-149028 | 5/2002 |
| JP | 2005-043537 | 2/2005 |

OTHER PUBLICATIONS

Jul. 20, 2010 Office Action in Japanese Patent Application No. 2009-165611 (with English translation).

Apr. 15, 2011 Office Action in Chinese Patent Application No. 200910169688.5 (with English translation).

* cited by examiner (a) BEFORE UNSEALING (b) AFTER UNSEALING (a)

(b)

PROCESS CARTRIDGE AND IMAGE FORMING APPARATUS

FIELD OF THE INVENTION AND RELATED ART

The present invention relates to a process cartridge in an electrophotographic image forming apparatus and the image forming apparatus.

The electrophotographic image forming apparatus forms an image on a recording material (recording medium) through electrophotography. For example, the image forming apparatus includes an electrophotographic copying machine, an electrophotographic printer (such as an LED printer or a laser beam printer), an electrophotographic facsimile machine, an electrophotographic word processor, and the like.

The electrophotographic image forming apparatus such as a printer forms a latent image by subjecting a uniformly charged image bearing member to selective light exposure corresponding to image information. This latent image is developed with a developer and then a resultant developer image is transferred onto the recording material. The transferred developer image is fixed as a fixed image on the recording material by a fixing device, so that image recording is effected. The image bearing member after the developer image is transferred onto the recording material is subjected to removal of an untransferred residual developer by a cleaning member to be subjected to image formation repetitively.

In such an electrophotographic image forming apparatus, the developer is required to be supplied every time the developer is used up. However, a supplying operation of this developer is not only burdensome but also accompanied with contamination in some cases. Further, maintenance of respective members can be performed only by an expert service person. As a result, in many cases, a user has been accompanied with inconvenience.

In these circumstances, a cleaning means as a process means and the image bearing member are integrally assembled into a cartridge (process cartridge), which are detachably mountable to an electrophotographic image forming apparatus main assembly. The process cartridge to be mounted to the electrophotographic image forming apparatus main assembly by the user has been put into practical use. The process cartridge has enabled the supply of the developer and exchange of parts, for the image bearing member, which reached the end of their lifetimes, thus facilitating maintenance. The process cartridge is prepared by integrally assembling at least the cleaning means as the process means and the image bearing member into the cartridge, which is detachably mountable to the image forming apparatus main assembly.

As one of types of the electrophotographic image forming apparatus, there is a type in which a plurality of developing means is rotatably held with respect to the image bearing member. For example, an electrophotographic color image forming apparatus described in Japanese Patent No. 3061805 includes a plurality of developing cartridges each including a developing means and a developer accommodating portion as process means and includes a drum cartridge including an image bearing member and a cleaning means. Further, the developing cartridges are concentratedly disposed in a substantially cylindrical shape in a state in which each of the developing cartridges is detachably mountable to a rotatable supporting member, so that developing portions of the respective developing cartridges are constituted so as to be successively movable to a position opposite to the image bearing member by rotation of the rotatable supporting member. Such an electrophotographic image forming apparatus is capable of forming a color image by a small-sized single image bearing member, thus being advantageous in downsizing an apparatus main assembly. In the above-described small-sized electrophotographic color image forming apparatus, the plurality of developing cartridges each including at least the developing means an the drum cartridge including at least the image bearing member are independently detachably mountable to the electrophotographic image forming apparatus main assembly.

With respect to the electrophotographic image forming apparatus of a process cartridge mounting and demounting type, when the user grips the process cartridge tightly during mounting and demounting of the process cartridge, there is a possibility of deformation of a container frame to cause leakage to a developer and an untransferred residual developer which are contained in a container. In view of such a possibility, such a constitution that a rib was provided as a reinforcing portion to enhance rigidity of the container frame has been proposed as described in Japanese Laid-Open Patent Application (JP-A) Hei 8-339148 and JP-A 2005-043537. Further, with respect to the rib provided to the container frame of the process cartridge, a constitution described in JP-A Sho 58-203479 or the like has also been proposed. That is, in JP-A 58-203479, such a constitution that localization of the untransferred residual developer is suppressed by providing a rib on a rear side in a container even when the use inclines the process cartridge is employed.

As described above, the constitutions which the rib was provided to the container frame as the reinforcing portion so as not to cause leakage of the developer and the untransferred residual developer even when the user gripped the process cartridge tightly have been proposed.

However, when the rib as the reinforcing portion is provided to a cleaning frame in which the untransferred residual developer is contained, depending on a constitution of the rib, there is a possibility of accumulation of the untransferred residual developer only on one side of the container, e.g., when image formation is effected concentratedly on one side of a sheet surface. Further, e.g., when the process cartridge including a cleaning frame is stored or used in a high-temperature environment or in a low-temperature environment, the cleaning frame causes thermal expansion or thermal contraction. Due to the thermal expansion or the thermal contraction of the cleaning frame, there is a possibility that a bearing surface for supporting a flexible sheet member which contacts the image bearing member for preventing leakage of the untransferred residual developer contained in a cleaning container is deformed to cause the leakage of the untransferred residual developer. For that reason, it was necessary to pay due attention to a position, a shape, and the like of the rib. Particularly, when the rib as the reinforcing portion is provided along a longitudinal direction of an opening of the cleaning frame, the flexible sheet member bearing surface which is provided at one end-side portion of the frame located along the longitudinal direction of the opening and contacts the image bearing member is influenced by the thermal deformation of the cleaning frame to cause thermal deformation such that the bearing surface causes waving. For that reason, there was a possibility of leakage of the untransferred residual developer contained in the cleaning frame.

In the above-described constitution in which the reinforcing portion is disposed in the cleaning frame of the process cartridge, in the case where the untransferred residual developer is accumulated on one side with respect to a drum rotational axis direction of the container, the reinforcing portion prevents movement of the untransferred residual developer in the drum rotational axis direction. As a result, the untransferred residual developer was locally accumulated with respect to the drum rotational axis direction, so that there was a possibility that the untransferred residual developer was not able to be efficiently accommodated in the cleaning frame.

SUMMARY OF THE INVENTION

A principal object of the present invention is to provide a process cartridge and an image forming apparatus which have solved the above-described problems. That is, the present invention provides the process cartridge and the image forming apparatus, which includes a sheet member for preventing a developer from leaking out of a developer accommodating portion, capable of suppressing waving of the sheet member contacting an image bearing member. Further, the present invention provides the process cartridge and the image forming apparatus which are constituted so that, even when image formation on a recording material is locally effected on one end side with respect to an axial direction of the image bearing member, the developer is movable toward the other end side with respect to the axial direction in a developer accommodating portion.

According to an aspect of the present invention is to provide a process cartridge detachably mountable to a main assembly of an image forming apparatus, comprising:

an image bearing member;

a cleaning member for removing a developer from the image bearing member;

a frame provided with an opening;

a developer accommodating portion for accommodating the developer which was removed by the cleaning member and has passed through the opening;

a sheet member, contacting the image bearing member, for preventing the developer from leaking out of the developer accommodating portion;

a supporting portion, provided to the frame, for supporting the sheet member;

a reinforcing portion, provided to the frame, connecting a one end-side portion of the frame located upstream of the opening with the other end-side portion of the frame located downstream of the opening, with respect to a rotational direction of the image bearing member; and a space, provided downstream of the reinforcing portion with respect to a direction from the opening toward the developer accommodating portion, for permitting movement of the developer in an axial direction of the image bearing member.

According to another aspect of the present invention, there is provided an image forming apparatus for forming an image on a recording material, comprising:

(i) mounting means;

(ii) a process cartridge detachably mountable to the mounting means, comprising:

an image bearing member;

a cleaning member for removing a developer from the image bearing member;

a frame provided with an opening;

a developer accommodating portion for accommodating the developer which was removed by the cleaning member and has passed through the opening;

a sheet member, contacting the image bearing member, for preventing the developer from leaking out of the developer accommodating portion;

a supporting portion, provided to the frame, for supporting the sheet member;

a reinforcing portion, provided to the frame, connecting a one end-side portion of the frame located upstream of the opening with the other end-side portion of the frame located downstream of the opening, with respect to a rotational direction of the image bearing member; and a space, provided downstream of the reinforcing portion with respect to a direction from the opening toward the developer accommodating portion, for permitting movement of the developer in an axial direction of the image bearing member; and (iii) conveying means for conveying the recording material.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, preferred embodiments for carrying out the present invention will be described in detail. However, these embodiments are representative embodiments of the present invention and the present invention is not limited thereto.

Embodiment 1

<General Arrangement of Electrophotographic Image Forming Apparatus>

Figure 1:
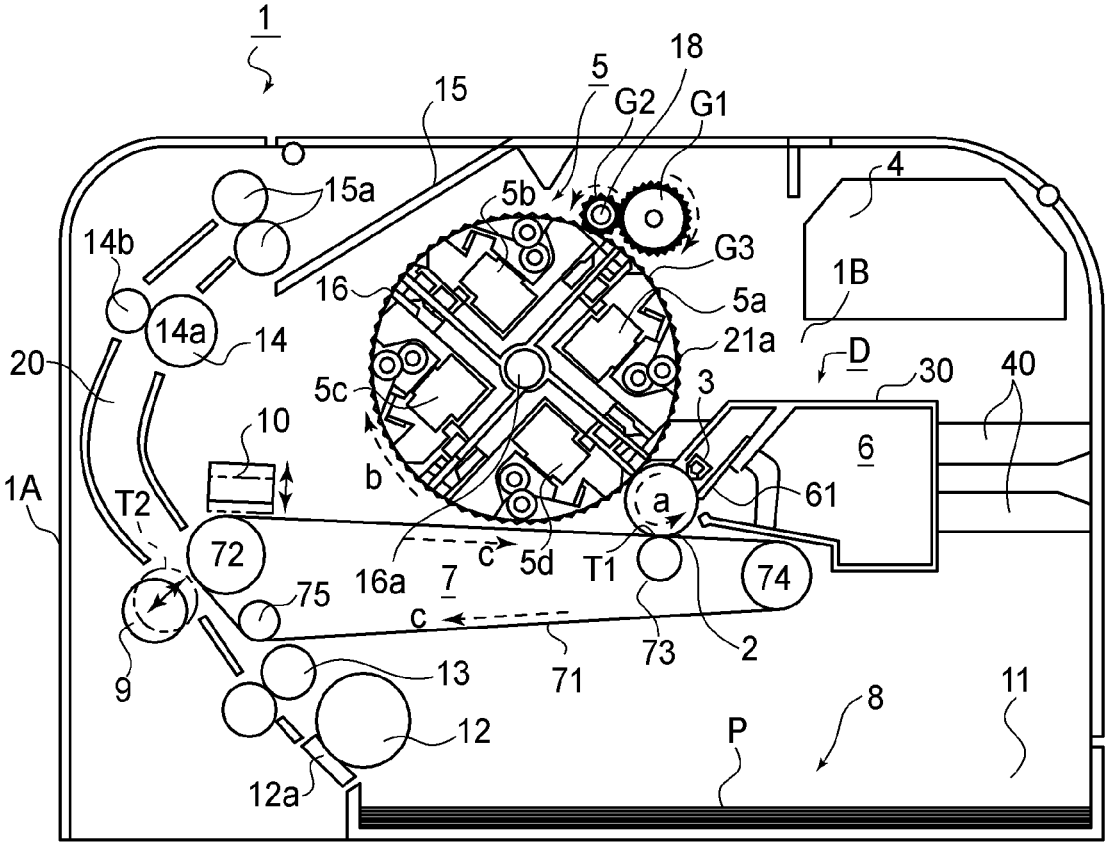
FIG. 1 is a schematic illustration of an image forming apparatus in a stand-by state in Embodiment 1.

FIG. 1 is a schematic illustration showing a general arrangement of an electrophotographic image forming apparatus in this embodiment. An image forming apparatus 1 is a four color-based full-color laser beam printer employing an electrophotographic process. That is, image formation on a sheet-like recording material P (a recording sheet, an OHP sheet, a label, and the like) is carried out on the basis of an electrical image signal input from a host device (not shown), such as a personal computer, an image reader, or a remote facsimile machine, to a control circuit portion (not shown). The control circuit portion (control means: CPU) exchanges various pieces of electrical information with the host device or an operating portion (not shown) and effects centralized control of an image forming operation of the image forming apparatus in accordance with a reinforcing portion control program or a predetermined reference table. Thus, the image forming operation described below is controlled by the control circuit portion.

Inside the image forming apparatus 1, an electrophotographic photosensitive drum 2 as a rotatable image bearing member (hereinafter simply referred to as a "drum") is disposed. This drum 2 is rotationally driven at a predetermined speed (process speed) in a counterclockwise direction indicated by a broken-line arrow a by a driving mechanism (not shown). Around the drum 2, process means acting on the drum 2 are disposed. In this embodiment, a charging means 3 for electrically charging the drum 2 uniformly, an exposure means 4 for forming a latent image by subjecting the uniformly charged surface of the drum 2 to selective light exposure, and a developing means 5 for developing (visualizing) the latent image with a developer (visualizing powder, hereinafter referred to as "toner") are disposed. Further, a drum cleaning means 6 for removing residual toner remaining on the drum 2 after primary transfer is disposed.

In this embodiment, the charging means 3 is a contact charging roller. The exposure means 4 is a laser scanner.

The developing means 5 is a rotary-type developing means including a (rotatable) supporting member 16 for supporting a plurality of developing devices and for successively carrying each of the developing devices to a developing position by rotation thereof (hereinafter referred to as a "rotary"). In this embodiment, the developing means 5 includes four developing devices, for developing the latent image formed on the drum 2 with corresponding color toner, consisting of a yellow developing device 5*a*, a magenta developing device 5*b*, a cyan developing device 5*c*, and a black developing device 5*d*. In the yellow developing device 5*a*, yellow (Y) toner is accommodated. In the magenta developing device 5*b*, magenta (M) toner is accommodated. In the cyan developing device 5*c*, cyan (C) toner is accommodated. In the black developing device 5*d*, black (Bk) toner is accommodated. The rotary 16 is rotatable about a center supporting shaft 16*a* and a rotational force of a drive gear G1 driven by a motor-driven mechanism (not shown) for the rotary is transmitted to a rotary gear G3 through an idler gear G2. As a result, the rotary 16 is rotated about the center supporting shaft 16*a* in a clockwise direction indicated by a broken-line arrow b. The control circuit portion controls the motor-driven mechanism for the rotary so as to rotate the rotary 16 in a predetermined indexing manner. The respective developing devices 5*a*, 5*b*, 5*c* and 5*d* may be of a stationary type in which they are fixed to the rotary 16 and may also be of a developing cartridge type in which they are detachably mountable to the rotary 16. In the case of the stationary type, to each of the developing devices 5*a*, 5*b*, 5*c* and 5*d*, a toner supplying means for supplying toner of a corresponding color is provided. In this embodiment, the developing cartridge type developing devices are used.

The drum cleaning means 6 is a blade cleaning device using a cleaning blade 61 as a cleaning member, acting on the drum 2, for removing untransferred residual toner (untransferred residual developer). The toner removed from the drum surface is accommodated in a cleaner container 30.

In this embodiment, the drum 2, the charging means 3, and the drum cleaning means 6 are integrally assembled into a cartridge to prepare a process cartridge D detachably mountable to a predetermined mounting portion 1B of an apparatus main assembly 1A of the image forming apparatus 1. The apparatus main assembly 1A constitutes an image forming apparatus portion from which the process cartridge D is excluded.

Below or under the process cartridge D and the developing means 5, an intermediary transfer unit 7 as a transfer means is provided. This unit 7 includes an endless intermediary transfer belt 71, as an intermediary transfer member, which is formed of a dielectric member and has flexibility (hereinafter simply referred to as a "belt"). This belt 71 is stretched around a secondary transfer opposite roller 72, a primary transfer roller 73, a belt driving roller 74, and a tension roller 75. The primary transfer roller 73 contacts the belt 71 contacting the drum 2. A contact portion between the drum 2 and the belt 71 is a primary transfer nip T1. The belt 71 is circulation-moved at a speed corresponding to the rotational speed of the drum 2 in the clockwise direction indicated by a broken-line arrow c by the drive of the driving roller 74.

In the neighborhood of the secondary transfer opposite roller 72, a secondary transfer roller 9 is provided. This secondary transfer roller 9 is movable between an operating position, indicated by a chain double-dashed line, in which the secondary transfer roller 9 contacts the belt 71 by a moving mechanism (not shown) and a non-operating position, indicated by a solid line, in which the secondary transfer roller 9 is separated from the belt 71. The secondary transfer roller 9 is held at the non-operating position during a normal operation and is moved to the operating position with predetermined timing. In a state in which the secondary transfer roller 9 is moved to the operating position, a contact portion between the secondary transfer roller 9 and the belt 71 is a secondary transfer nip T2.

Further, in the neighborhood of the secondary transfer opposite roller 72, a belt cleaner 10 as a belt cleaning means is provided downstream of the secondary transfer roller 9 with respect to a belt movement direction. The belt cleaner 10 is a means for removing untransferred residual toner, after secondary transfer, from the surface of the belt 71. The belt cleaner 10 is movable between an operating position, indicated by the chain double-dashed line, in which a cleaning member contacts the surface of the belt 71 by a moving mechanism (not shown) and a non-operating position, indicated by the solid line, in which the cleaning member is separated from the belt 71. The belt cleaner 10 is held at the non-operating position during the normal operation. Then, the belt cleaner 10 is moved to the operating position with predetermined timing.

Below the intermediary transfer unit 7, a recording material feeding unit 8 is provided. This unit 8 includes a sheet feeding cassette 11 in which sheets of a recording material P are stacked and accommodated, a sheet feeding roller 12, and a separating pad 12*a*. A recording material conveying path (a conveying means for conveying the recording material) 20 upwardly extending from the sheet feeding roller 12 of the above-described unit 8 is provided. From a lower portion to an upper portion of the recording material conveying path 20, a registration roller pair 13, the secondary transfer roller 9, a fixing device 14, and a sheet discharging roller pair 15*a* are provided along the recording material conveying path 20. The fixing device 14 includes a fixing roller 14*a* and a pressing roller 14*b*. At an upper surface of the apparatus main assembly 1A, a sheet discharging tray 15 is provided.

An operation for forming a full-color image is as follows. FIG. 1 shows a stand-by state of the image forming apparatus. The rotary 16 is held in a state of stop of rotation at a rotational angle, as a home position angle, at which the yellow developing device 5*a* is located at a forward (front-side) position (a rightward (right-hand) position in FIG. 1). In this state, the control circuit portion awaits input of an image formation start signal.

Figure 2:
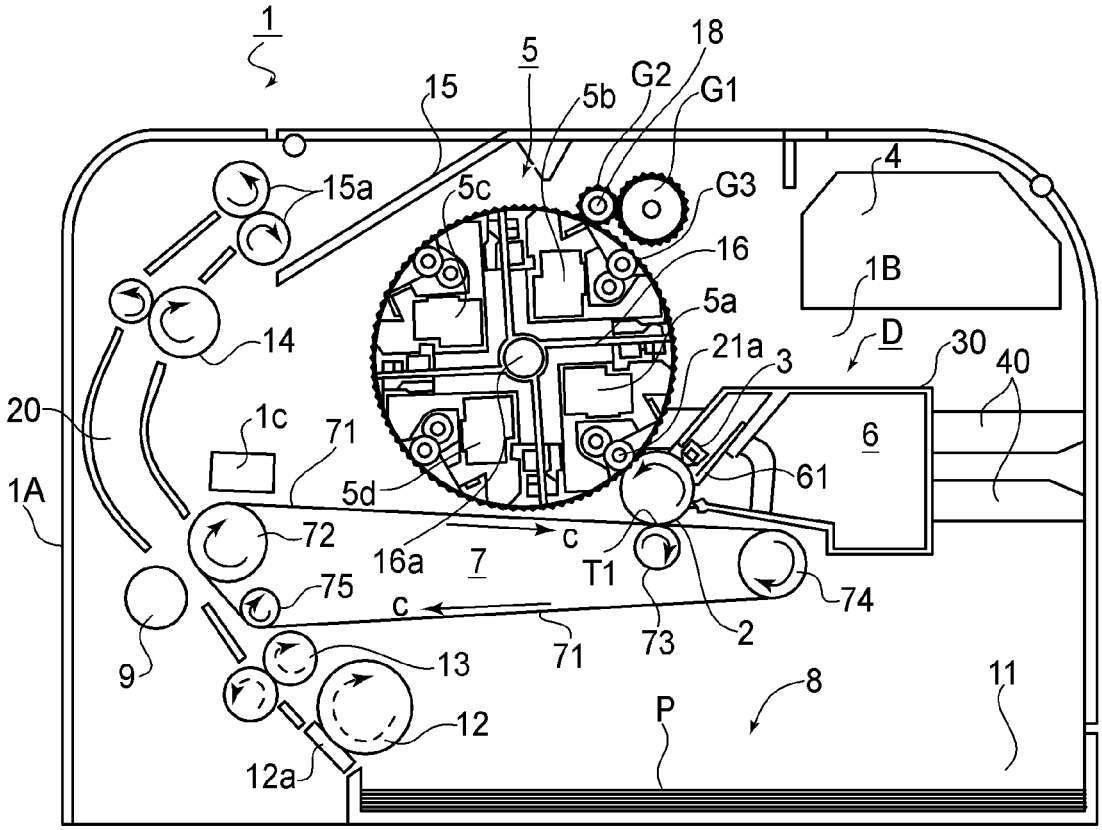
FIG. 2 is a schematic illustration of the image forming apparatus in a state in which a yellow developing device is located at a developing position.

When the image formation start signal is input, the control circuit portion starts rotational device of the drum 2 by actuating a main motor (not shown). Further, the control circuit portion drives the motor-driven mechanism for the rotary to rotate the rotary 16, in the clockwise direction b, about the center supporting shaft 16*a* through the gears G1, G2 and G3 by a predetermined angle from a stand-by position angle shown in FIG. 1 and then stops the rotation of the rotary 16. By this rotation of the rotary 16, the yellow developing device 5*a* is moved to the developing position with respect to the drum 2, thus being positioned as shown in FIG. 2. A reference numeral 21 represents a developing roller for the yellow developing device 5*a*.

The developing position with respect to the drum 2 in this embodiment is a position in which a developing roller 21 as a developer carrying member for carrying the toner and supplying the toner to the drum 2 is placed in a state in which the developing roller 21 opposes the drum 2 in a predetermined manner to contact the drum 2. At the developing position, in order to stably bring the developing roller 21 into contact with the drum 2, the rotary 16 is urged, about a swingable shaft 18, toward the drum 2. As a result, the developing roller 21 of the developing device 5 is placed in a state in which the developing roller 21 contacts the drum 2 with a predetermined pressure. In this embodiment, the swingable shaft 18 and a shaft of the idler gear G2 are co-axial. Incidentally, in this embodiment, the developing roller 21 contacts the drum 2 but may also oppose the drum 2 with a predetermined slight spacing while spacer rollers provided at both longitudinal end portions of the developing roller 21 contact both longitudinal end portions of the drum 2.

To the yellow developing device 5*a* moved to the developing position as shown in FIG. 2, a driving force and a developing bias are applied from the apparatus main assembly 1A side. The laser scanner unit 4 is also driven. Further, the belt 71 is also rotationally driven. The secondary transfer roller 9 and the belt cleaner 10 are held at their non-operating positions in which they are separated from the belt 71. To the charging roller 3, a predetermined charging bias is applied. As a result, a surface of the rotating drum 2 is electrically charged uniformly to a predetermined polarity and a predetermined potential. Laser light modulated correspondingly to a Y color component image signal for a full-color image is output from the laser scanner unit 4, so that the electrically charged surface of the drum 2 is subjected to scanning exposure to the laser light. As a result, an electrostatic latent image corresponding to the Y component image is formed on the drum surface. The electrostatic latent image is developed as a Y color toner image by the yellow developing device 5*a*. In this embodiment, the electrostatic latent image is reversely developed with negatively chargeable toner having the same charge polarity as that of the drum 2. The Y color toner image is primary-transferred onto the surface of the belt 71 in the primary transfer nip T1. To the primary transfer roller 73, the primary transfer bias which has an opposite polarity to the charge polarity of the toner and has a predetermined potential is applied. The drum surface after the primary transfer is subjected to cleaning by the cleaning blade.

When the primary transfer of the Y color toner image onto the belt 71 is completed, the rotary 16 is rotated by a predetermined angle in the clockwise direction in an intermittent manner. As a result, at this time, the magenta developing device 5*b* is moved to the developing position with respect to the drum 2, thus being positioned. Then, the drum 2 is subjected to steps of charging, exposure, and developing for forming on the drum 2 an M color toner image corresponding to an M color component image for the full-color image. The M color toner image is primary-transferred, in the primary transfer nip T1, onto the Y color toner image which has already been formed on the belt 71 in a predetermined alignment state in a superposition manner.

When the primary transfer of the M color toner image onto the belt 71 is completed, the rotary 16 is rotated by a predetermined angle in the clockwise direction in an intermittent manner. As a result, at this time, the cyan developing device 5*c* is moved to the developing position with respect to the drum 2, thus being positioned. Then, the drum 2 is subjected to steps of charging, exposure, and developing for forming on the drum 2 a C color toner image corresponding to a C color component image for the full-color image. The C color toner image is primary-transferred, in the primary transfer nip T1, onto the Y and M color toner image which has already been formed on the belt 71 in a predetermined alignment state in a superposition manner.

When the primary transfer of the C color toner image onto the belt 71 is completed, the rotary 16 is rotated by a predetermined angle in the clockwise direction in an intermittent manner. As a result, at this time, the black developing device 5*d* is moved to the developing position with respect to the drum 2, thus being positioned. Then, the drum 2 is subjected to steps of charging, exposure, and developing for forming on the drum 2 a Bk color toner image corresponding to a Bk color component image for the full-color image. The Bk color toner image is primary-transferred, in the primary transfer nip T1, onto the Y, M and C color toner image which has already been formed on the belt 71 in a predetermined alignment state in a superposition manner.

Thus, on the belt 71, unfixed full-color toner images of four colors of Y, M, C and Bk are synthetically formed.

Incidentally, the order of the colors of the color toner images to be successively formed on the drum 2 is not limited to the order of Y, M, C and Bk as in this embodiment but can be changed to an appropriate order.

Figure 3:
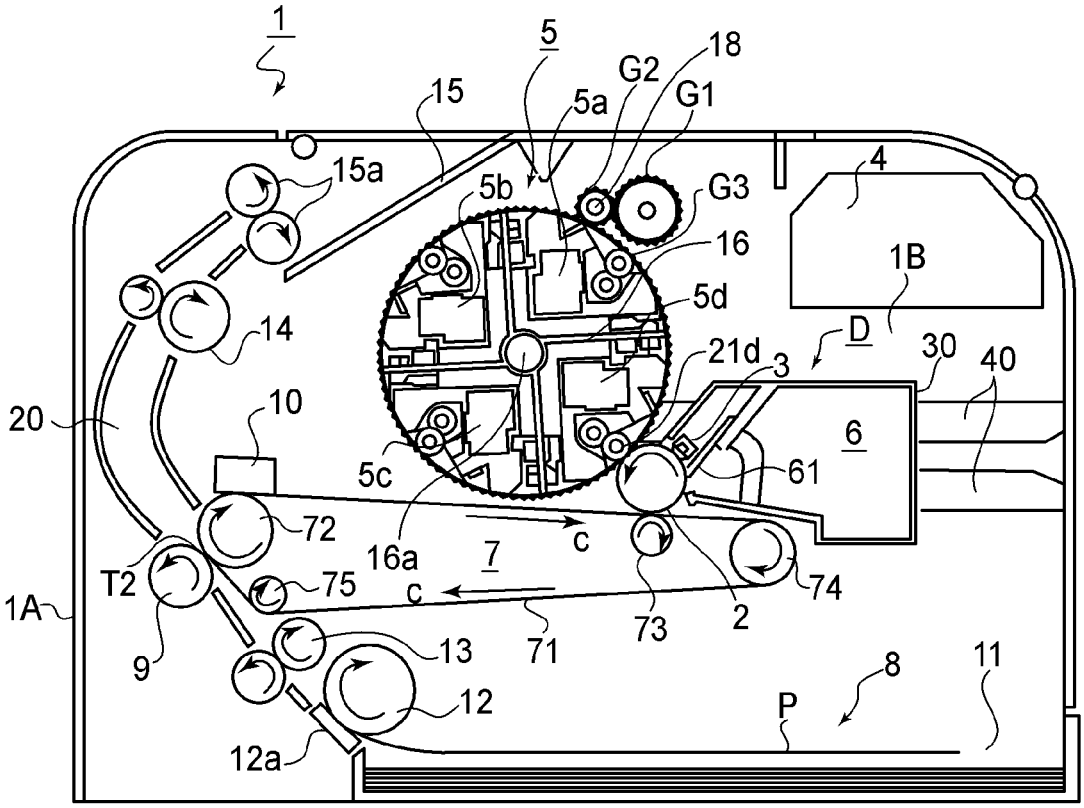
FIG. 3 is a schematic illustration of the image forming apparatus in a state in which a black developing device is located at the developing position.

Before an image leading end of the unfixed full-color toner images of four colors formed on the belt 71 reaches the position of the secondary transfer roller 9 by the movement of the belt 71, the secondary transfer roller 9 is moved to the operating position in which the secondary transfer roller 9 contacts the belt 71. Further, the belt cleaner 10 is also moved to the operating position with respect to the belt 71. FIG. 3 shows this state. In FIG. 3, the black developing device 5*d* is located at the developing position with respect to the drum 2. A reference numeral 21*d* represents a developing roller for the black developing device 5*d*.

With predetermined control timing, the sheet feeding roller 12 is driven. As a result, one of the sheets of the recording material P stacked and accommodated in the sheet feeding cassette 11 is separated and fed by cooperation between the sheet feeding roller 12 and the separating pad 12*a*. The fed recording material P is introduced into the secondary transfer nip T2, which is the contact portion between the secondary transfer roller 9 and the belt 71, by the registration roller pair 13 with predetermined control timing. To the secondary transfer roller 9, a secondary transfer bias having the opposite polarity to the toner charge polarity and having a predetermined potential is applied. As a result, in a process in which the recording material P is nip-conveyed in the secondary transfer nip T2, the superposed four color toner images are collectively secondary-transferred onto the surface of the recording material P.

The recording material P is separated from the surface of the belt 71 and is then introduced into the fixing device 14, so that the recording material P is heated and pressed in a fixing nip. As a result, the respective color toner images are fixed (melted and color-mixed) on the recording material P. Then, the recording material P comes out of the fixing device 14 and is discharged as a full-color image-formed product onto the sheet discharge tray 15 by the sheet discharging roller pair 15*a*.

The untransferred residual toner, after the secondary transfer, remaining on the surface of the belt 71 after the recording material separation is removed by the belt cleaner 10.

That is, the rotary 16 supporting the plurality of developing devices different in development color is rotated in the indexing manner so as to move one of the developing devices to the developing position in which the developing device opposes the drum 2 in a predetermined manner. At the developing position, the latent image formed on the drum 2 is developed as a developer image by the developing device. This operation is successively performed with respect to the plurality of the developing devices in a switching manner, so that formation of a color image on the recording material P is effected through the intermediary transfer member 71.

The control circuit portion awaits input of a subsequent image formation start signal by placing the image forming apparatus in the stand-by state shown in FIG. 1 when an image forming job on a single sheet or a plurality of successive sheets is completed. That is, drive of the drum 2, the laser scanner unit 4, the belt 71, and the like is stopped. The secondary transfer roller 9 and the belt cleaner 10 are moved to their non-operating positions. The rotary 16 is rotated so that its angle is returned to the home position angle as shown in FIG. 1, thus being placed in the stand-by state.

In the case of a monochromatic image forming mode, only image formation by the black developing device 5*d* is effected. The control circuit portion returns the state of the image forming apparatus to the stand-by state shown in FIG. 1 when a monochromatic image forming job on one sheet or a plurality of successive sheets is completed, thus awaiting input of a subsequent image formation start signal.

<Mounting and Demounting Operation of Process Cartridge D>

Figure 4:
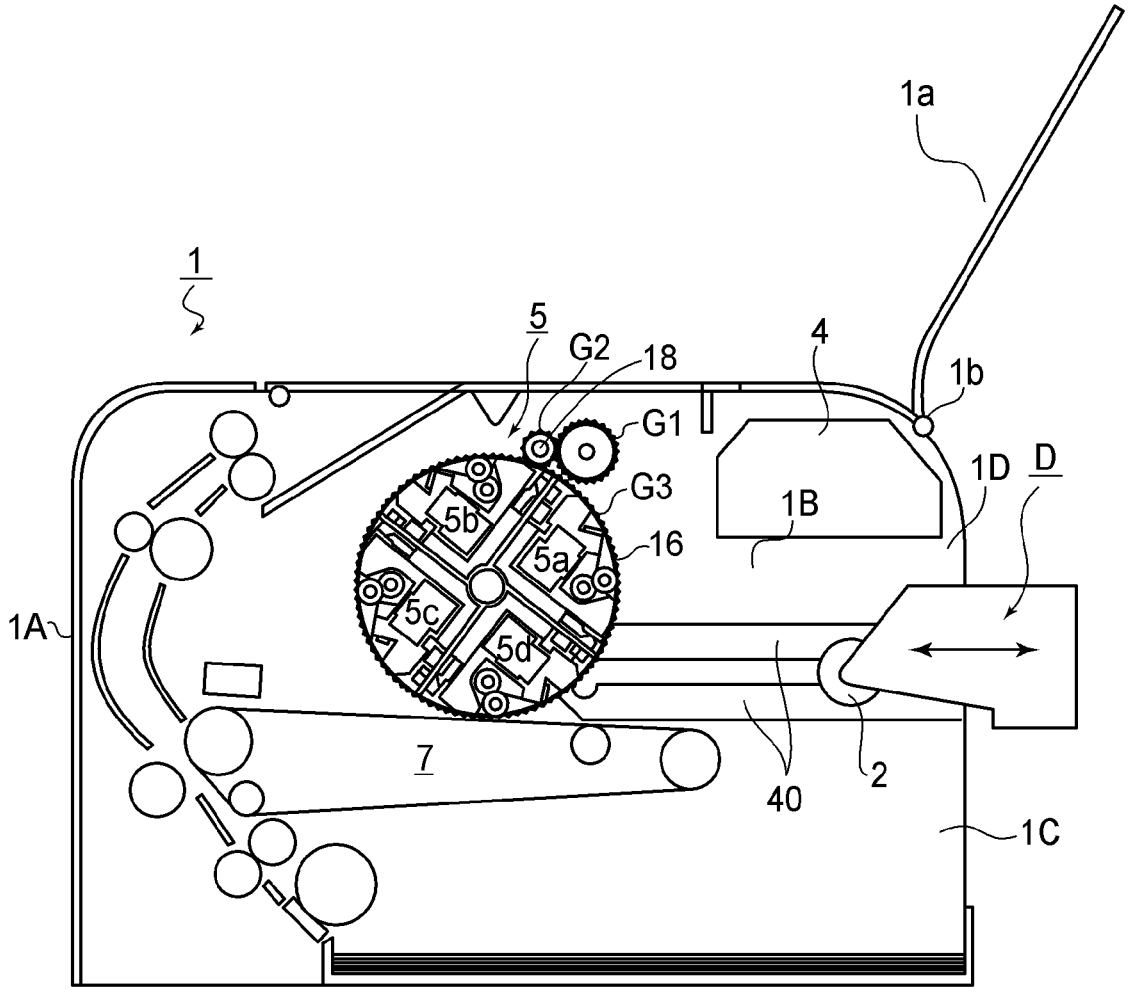
FIG. 4 is a schematic illustration of the image forming apparatus in a state in which a front cover is opened.

As described above, in this embodiment, the process cartridge D are prepared by integrally assembling the drum 2, the charging roller 3, and the cleaning means 6 into the cartridge, which is detachably mountable to the apparatus main assembly 1A. When parts such as the drum and the like reach the end of their lifetimes or when an amount of the untransferred residual toner to be accommodated in the cleaner container 30 reaches full, the image forming apparatus 1 can be used uninterruptedly by exchanging the process cartridge D. In this embodiment, mounting and demounting of the process cartridge D with respect to the apparatus main assembly 1A are performed in the following manner. That is, the process cartridge D is subjected to a mounting and demounting operation by opening a front cover 1*a* of the apparatus main assembly 1A about a hinge portion 1*b* to open the inside of the apparatus main assembly 1A as shown in FIG. 4. When the cover 1*a* is opened, from an opening 1D where the cover 1*a* is opened, a process cartridge mounting portion 1B in the apparatus main assembly 1A is in sight. At lest and right opposite wall portions of the mounting portion 1B, guide members 40 (mounting means) for guiding the process cartridge D so that the process cartridge D is inserted into and detached from the apparatus main assembly 1A are provided. That is, to left and right opposite side plates of a mainframe 1C constituting a framework of the apparatus main assembly 1A, the associated guide members 40 are provided, respectively. Further, by an interrelating mechanism (not shown) interrelated with movement of the cover 1*a*, disconnection of a drive output (not shown) on the apparatus main assembly 1A side from a drive input portion (not shown) on the process cartridge D side mounted to the mounting portion 1B is made. Further, positioning fixation of the process cartridge D by a positioning fixation means (not shown) on the apparatus main assembly 1A side is released. Further, conduction of an output electrical contact (not shown) on the apparatus main assembly 1A side to an input electrical contact (not shown) on the process cartridge D side is ceased. As a result, demounting of the process cartridge D mounted in the apparatus main assembly 1A is made possible. The user grasps a rear surface-side portion of the process cartridge D (opposite from a drum 2—side portion) and then draws and moves the process cartridge D along the guide members 40, so that the process cartridge D is taken out through the opening 1D.

The mounting of the process cartridge D is performed through a reverse procedure of the above-described procedure. That is, the user grasps the rear surface-side portion of the process cartridge D and intents the process cartridge D into the apparatus main assembly 1A through the opening 1D with a front surface side (the drum 2 side) 1D with a front surface side (the drum 2 side) directed toward the mounting portion B. Left and right side portions to be guided (not shown) of the process cartridge D are engaged with the left and right guide members 40, respectively, on the apparatus main assembly 1A side. Then, the process cartridge D is sufficiently pushed and moved into the mounting portion 1B along the guide members 40 until the process cartridge D is stopped by a positioning portion. Thereafter, the cover 1*a* is closed. By an interrelating mechanism interrelated with closing movement of the cover la, positioning fixation of the process cartridge D through a positioning fixation means on the apparatus main assembly 1A side is effected. A position of the positioning-fixed process cartridge D is a mounting position. Further, to the drive input portion (not shown) on the process cartridge D side, the drive output portion (not shown) on the apparatus main assembly 1A side is connected. Further, with the input electric contact (not shown) on the process cartridge D side, the output electric conduct (not shown) is brought into conduction. As a result, the image forming apparatus 1 is put into an initial operation to be placed in a state capable of an image forming operation.

<Developing Device 5 and Mounting and Demounting Operation Thereof>

Figure 5:
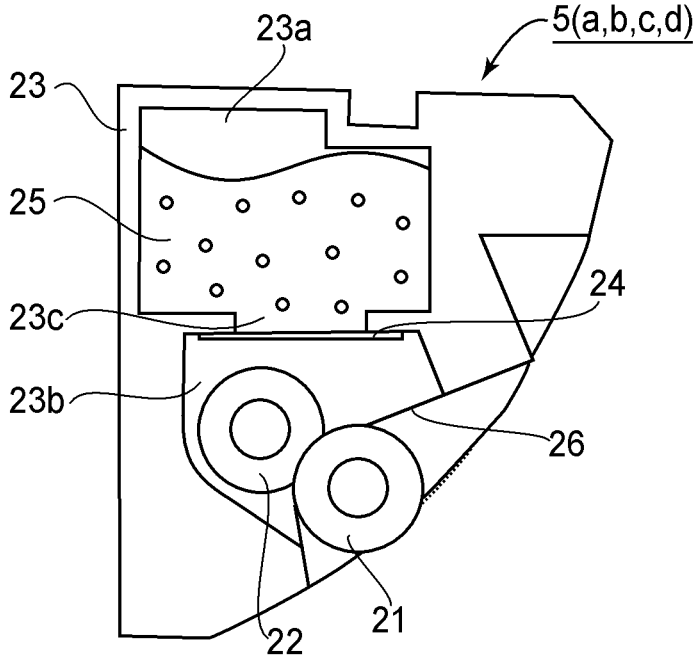
FIGS. 5(*a*) and 5(*b*) are schematic sectional views of a developing cartridge, wherein FIG. 5(*a*) shows a state before a toner seal of the developing cartridge is unsealed and FIG. 5(*b*) shows a state after the toner seal is unsealed.
Figure 5:
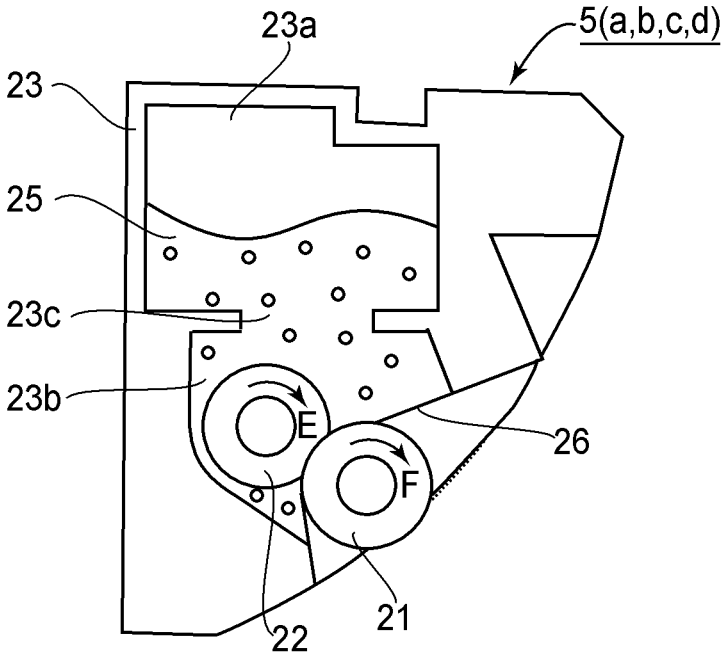

The yellow developing device 5*a*, the magenta developing device 5*b*, the cyan developing device 5*c*, and the black developing device 5*d* are collectively disposed in a substantially cylindrical shape at predetermined associated mounting positions, respectively, of the rotary 16 so that each of the developing devices is detachably mountable to the predetermined associated mounting position as the developing cartridge. The respective developing devices 5 (5*a*, 5*b*, 5*c*, 5*d*) have the same constitution except that the colors of toners accommodated in the developing devices are different from each other. FIGS. 5(*a*) and 5(*b*) are schematic structural views of each developing device 5, wherein FIG. 5(*a*) is a schematic sectional view of the developing device 5 before unsealing of a toner seal and FIG. 5(*b*) is a schematic sectional view of the developing device 5 after the unsealing of the toner seal.

A developing container 23 of the developing device 5 includes a developer accommodating chamber 23*a* and a developing chamber 23*b* including a developing roller 21 and a developer feeding roller 22. Between the developer accommodating chamber 23*a* and the developing chamber 23*b*, a developer supply opening 23*c*. In an unused state in which the developing device 5 is delivered to the user, as shown in FIG. 5(*a*), a film-like toner (developer) seal 24 for separating the developer accommodating chamber 23*a* and the developing chamber 23*b* is fixed in the developing container 23 by a method such as welding. By removing the toner (developer) seal 24 before use, as shown in FIG. 5(*b*), toner 25 in the developer accommodating chamber 25*a* enters the developing chamber 23*b*. The developing device 5 is mounted at the predetermined mounting position of the rotary 16 in a state in which the toner seal 24 is unsealed. The developing device 5 is subjected to transmission of a driving force and application of a developing bias from the apparatus main assembly 1A side in a state in which the developing device 5 is moved to and positioned at the developing position by the rotation of the rotary 16. As a result, the developer feeding roller 22 is rotated in a direction indicated by an arrow E to feed the toner 25 to the developing roller 21. The developing roller 21 is constituted by an elastic rubber roller and is rotated in a direction indicated by an arrow F, so that the toner 25 on the developing roller 21 is regulated by a developing blade 26 to be supplied toward the drum 2. The developing bias is applied to the developing roller 21. As a result, the electrostatic latent image on the drum 2 is developed as the toner image. The toner left on the developing roller 21 after the development is removed by the developer feeding roller 22. Thereafter, the toner 25 is fed to the developing roller 21 again by the developer feeding roller 22.

In each of the developing devices 5 (5*a*, 5*b*, 5*c*, 5*d*) as the developing cartridge, with use of the developing device for image formation, the toner 25 accommodated in the developing device is consumed. Therefore, e.g., a detecting means (not shown) for detecting a remaining amount of the toner 25 in each of the developing devices 5 (5*a*, 5*b*, 5*c*, 5*d*) is provided to each of the developing devices 5. Then, in the control circuit portion, a remaining amount value of the toner 25 detected by the detecting means is compared with a preset threshold of the toner amount for advance notice or warning of a developing device lifetime. Then, with respect to the developing device in which the toner 25 is decreased in amount to the remaining amount value less than the threshold, the advance notice or warning of the lifetime of the developing device is displayed at a display portion (not shown). By this display, the user is urged to prepare a developing device for exchange or to exchange the developing device, so that a quality of an output image is maintained.

Figure 6:
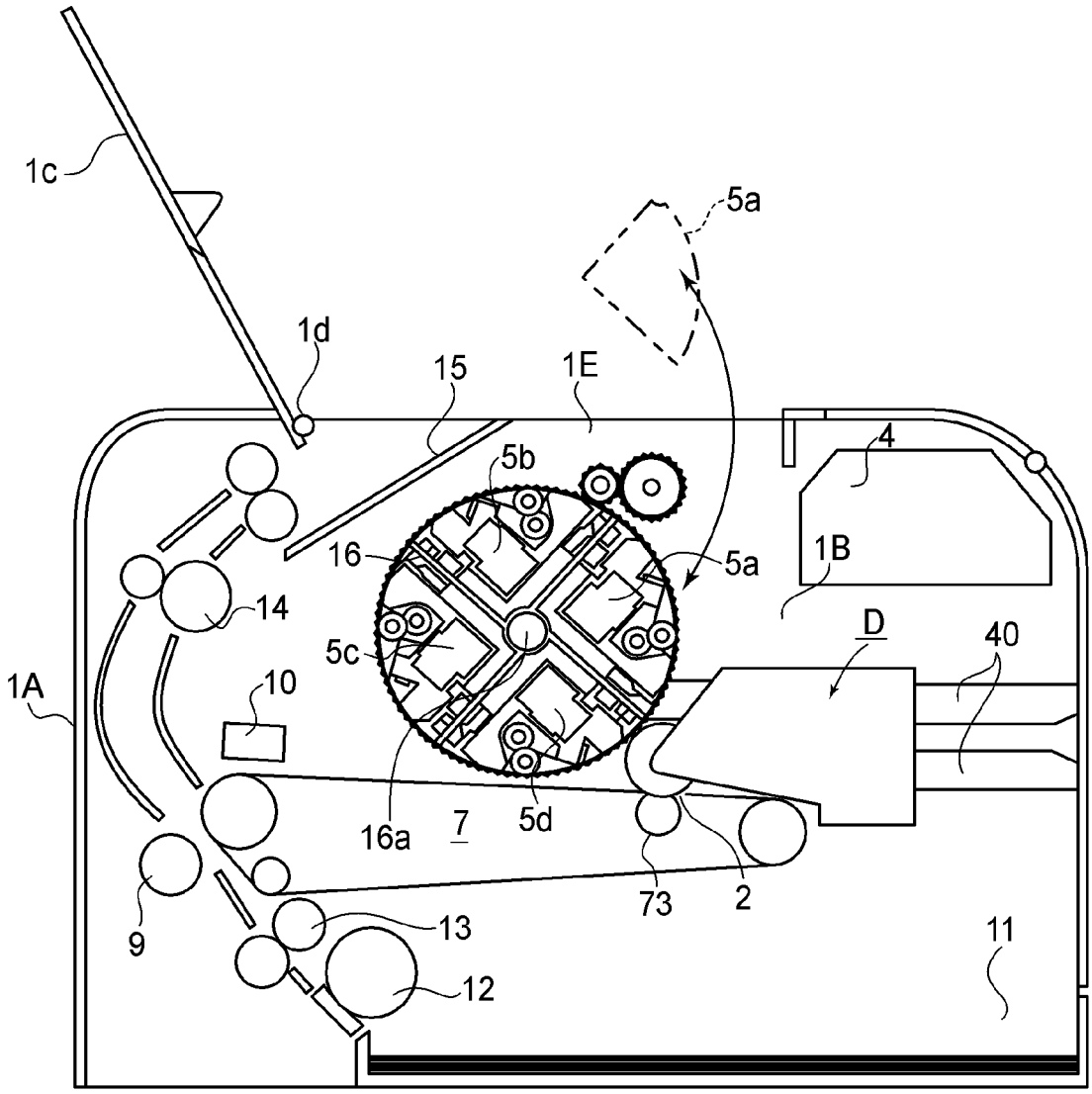
FIG. 6 is a schematic illustration of the image forming apparatus in a state in which a top cover is opened.

In this embodiment, the mounting and demounting of the developing device 5 with respect to the apparatus main assembly 1A are performed as follows. That is, the developing device 5 is, as shown in FIG. 6, subjected to a mounting and demounting operation with respect to the rotary 16 by opening the top cover 1*c* of the apparatus main assembly 1A about the hinge portion 1*d* to open the inside of the apparatus main assembly 1A. When the cover 1*c* is opened, a part of a top-side portion and a front-side portion of the rotary 16 in the apparatus main assembly 1A are in sight through an opening 1E. Then, the developing device located on the front side of the rotary 16 is configured to be detached from the rotary 16 so that the developing device can be taken out of the apparatus main assembly 1A through the opening E. Further, inversely, the developing device is configured to be inserted into the apparatus main assembly 1A through the opening 1E so that the developing device can be mounted to the front-side mounting portion of the rotary 16. Mounting and demounting means and mechanism of the respective developing devices 5 with respect to the rotary 16 and description thereof are omitted for the purpose of brevity. The rotary 16 is rotated by a motor-driven mechanism or manual driving mechanism for the rotary 16 (not shown) so that a developing device, to be exchanged, of the developing devices mounted to the rotary 16 can be located at the front-side mounting portion of the rotary 16. Then, the developing device is detached from the rotary 16 and a fresh developing device from which the toner seal 24 has been unsealed is mounted to the rotary 16. When a necessary exchange between the old developing device and the fresh developing device is completed, the top cover 1*c* is closed. As a result, the image forming apparatus is put into an initial operation to be placed in a state capable of an image forming operation.

In this embodiment, the developing device 5 is described by using the constitution including the developing roller 21, the developer feeding roller 22, the developing blade 26, the developing container 23 in which the developer accommodating chamber 23*a* and the developing chamber 23*b* are separated, and the toner seal 24 having sealed hermetically the developer accommodating chamber during shipment and transportation. However, the developing device 5 may only be required to include the developing roller 21 as a developer carrying member for carrying at least the toner 25 and supplying the toner 25 to the drum 2, so that various process means, parts, and constitutions are suitably applicable to the developing device 5.

<Process Cartridge>

Figure 7:
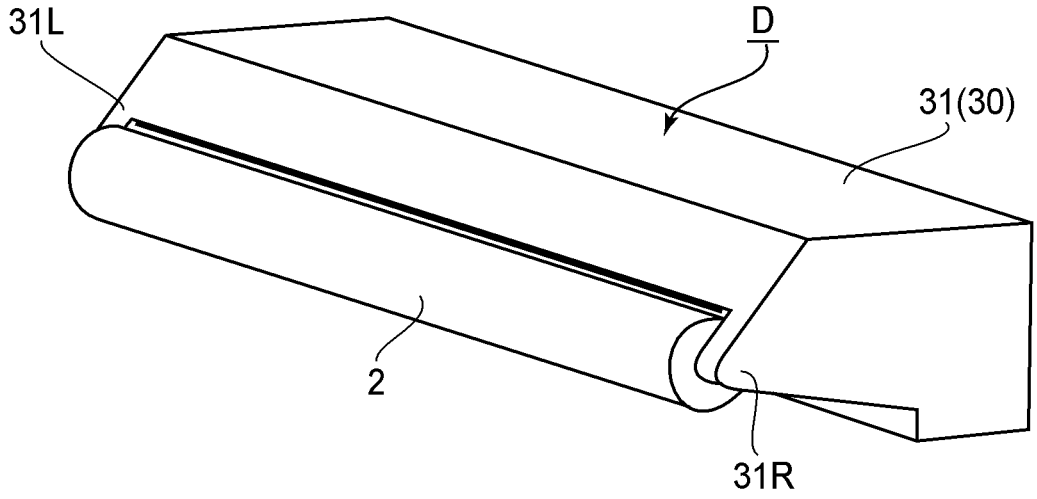
FIGS. 7(*a*) and 7(*b*) are schematic perspective views of a process cartridge, wherein FIG. 7(*a*) shows the process cartridge and FIG. 7(*b*) shows the process cartridge to which a cover member is mounted.
Figure 7:
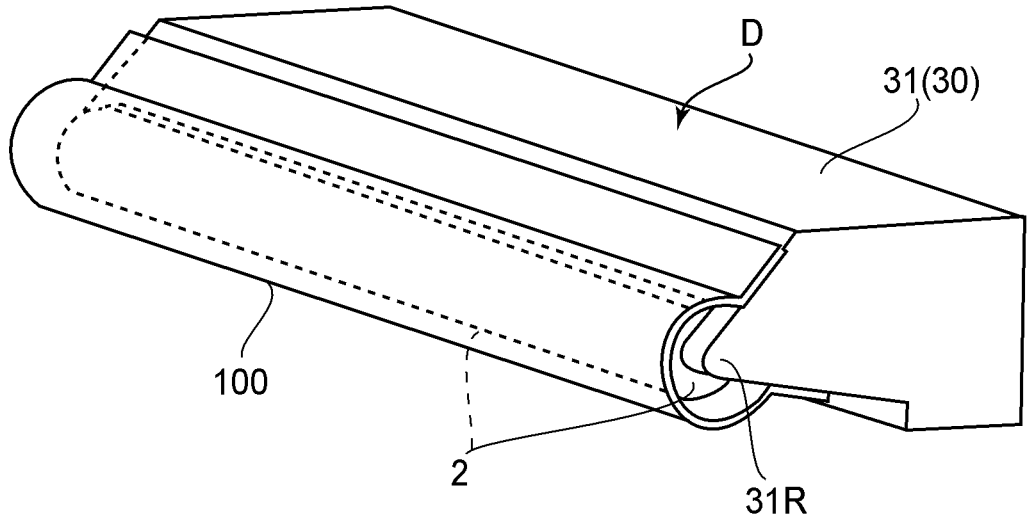

FIG. 7(*a*) is a schematic perspective view of the process cartridge D in this embodiment. During shipment and transportation of the process cartridge D, it is desirable that an influence of damage at the surface of the drum 2 or the like on image defect is eliminated. FIG. 7(*b*) is a schematic perspective view of the process cartridge D in a state in which a cover member 100 for protecting the drum 2 is mounted to the process cartridge D. The user removes the cover member 100 and then mounts the process cartridge D to the apparatus main assembly 1A, thus using the process cartridge D.

Figure 8:
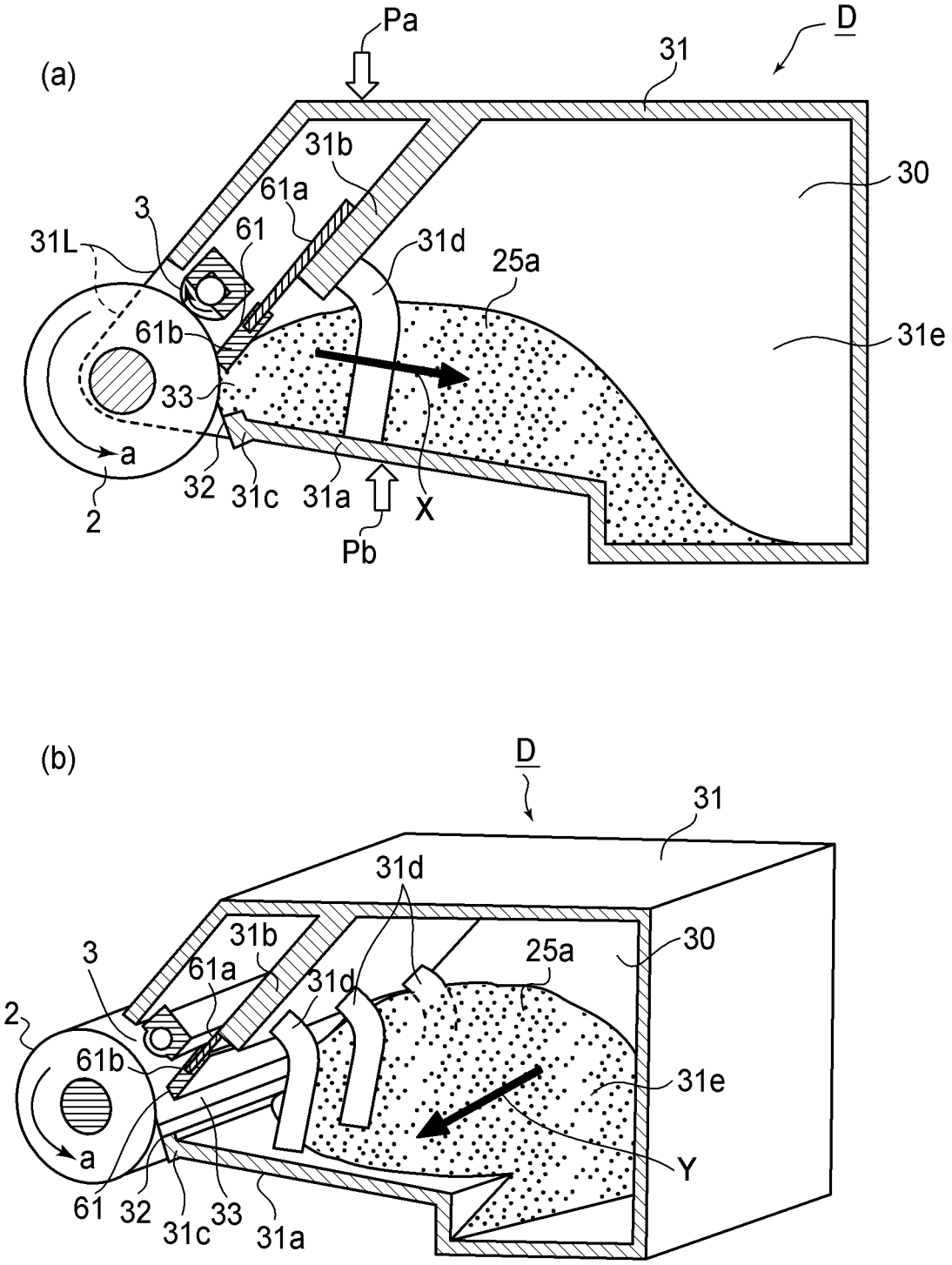
FIG. 8(*a*) is a schematic cross-sectional view of the process cartridge and FIG. 8(*b*) is a schematic perspective view of the process cartridge.

FIG. 8(*a*) is a schematic cross-sectional view of the process cartridge D and FIG. 8(*b*) is a schematic perspective sectional view of the process cartridge D. The process cartridge D in this embodiment is constituted by assembling the drum 2 as the image bearing member, and the charging means 3 and the cleaning means 6 as the process means acting or the drum 2, with respect to the cleaning frame 31 with a predetermined arrangement relationship. The cleaning frame 31 includes the cleaner container 30 as the developer accommodating portion for accommodating the untransferred residual toner (the untransferred residual developer). The drum 2 is, as shown in FIGS. 7(*a*) and 7(*b*), disposed between the left and right side plates 31L and 31R so as to be rotatably shaft-supported. The charging roller 3 as the charging means is disposed in parallel to the drum 2 and is provided to the cleaning frame 31 in a state in which the charging roller 3 is urged against the drum surface by an urging member (not shown) with a predetermined urging force. The charging roller 3 is rotated by the rotation of the drum 2. The cleaning blade 61 as the cleaning member is constituted by a supporting metal plate 61*a* and a rubber blade 61*b*. The cleaning blade 61 is disposed counter-directionally with respect to the rotational direction of the drum 2 in order to obtain a high cleaning performance. The supporting metal plate 61*a* is fixed to the cleaning frame 31 and the rubber blade 61*b* is brought into contact with the drum 2 in a predetermined area to form a nip. The cleaning blade 61 removes the untransferred residual toner on the drum 2 and accommodates the untransferred residual toner in the cleaner container 30. That is, the cleaning frame 31 is provided with an opening 33 in the neighborhood of a contact portion between the drum 2 and the cleaning blade 61. The untransferred residual toner 25*a* scraped by the cleaning blade 61 passes through the opening 33 to be accumulated in a direction indicated by an arrow X in FIG. 8(*a*), thus being accommodated in the cleaner container 30. In this embodiment, the untransferred residual toner 25*a* scraped by the cleaning blade 61 is naturally accumulated in the cleaner container 30 with no forced feeding mechanism.

Further, to the cleaning frame 31, a flexible sheet member 32 contacting the drum 2 so as not to leak the untransferred residual toner 25*a* accommodated in the cleaner container 30 out of the cleaner container 30 is provided. That is, the cleaning frame 31 includes one end-side portion 31*a* located upstream of the opening 33 with respect to the drum rotational direction a and the other end-side portion 31*b* located opposite to the one end-side portion 31*a* and downstream of the opening 33 with respect to the drum rotational direction a. To an end of the one end-side portion 31*a*, a first supporting portion 31*c* for supporting the flexible sheet member 32 is provided. This supporting portion 31*c* is provided along a longitudinal direction of the one end-side portion 31*a* (an axial direction of the drum 2). The flexible sheet member 32 is provided so that a base portion thereof is fixed to the supporting portion 31*c* along the longitudinal direction of the supporting portion 31*c* and an end thereof is brought into contact with the drum 2 so as to be codirectional with the rotational direction of the drum 2. A gap between the drum 2 and the end of the one end-side portion 31*a* at the opening 33 is closed by the flexible sheet member 32, so that leakage of the untransferred residual toner 25*a* accommodated in the cleaner container 30 out of the cleaner container 30 is prevented. The cleaning blade 61 is provided with the supporting metal plate 61*a* mounted to the other end-side portion 31*b* along the longitudinal direction of the opening 33, thus being provided to the cleaning frame 31. That is, the other end-side portion 31*b* is a second supporting portion for supporting the cleaning blade 61.

Further, the cleaning frame 31 is provided with a reinforcing portion 31*d* connecting the one end-side portion 31*a* and the other end-side portion 31*b* which are opposite to each other through the opening 33. The reinforcing portion 31*d* is provided at one position or a plurality of positions with intervals along the longitudinal direction of the opening 33. In FIG. 8(*b*), three reinforcing portions 31*d* are in sight. By providing the reinforcing portion(s) 31*d* as described above, the following effect is achieved. For example, during the mounting and demounting of the process cartridge D, the cleaning frame 31 is gripped by the user. For that reason, the cleaning frame 31 is subjected to a pressure in a vertical direction as indicated by arrows Pa and Pb in FIG. 8 (*a*). Even when the cleaning frame 31 is subjected to such a pressure, the cleaning frame 31 is prevented from being deformed largely in the directions Pa and Pb by the reinforcing portion 31*d*, so that it is possible to prevent the untransferred residual toner 25*a* from issuing from the inside of the cleaner container 30 due to an increase in internal pressure of the cleaner container 30 caused by the deformation.

Further, the cleaning frame 31 is configured to be provided with a space 31*e* which is located downstream of the reinforcing portion 31*d* via which the untransferred residual toner 25*a* is moved from the drum 2 toward the inside of the cleaner container 30 as the developer accommodating developer and which extends in the drum rotational axis direction. For that reason, movement of the untransferred residual toner 25*a* accommodated in the cleaner container 30 in the drum rotational axis direction is permitted by the space 31*e*. That is, the case where printing is effected locally on one end side of the drum with respect to the drum rotational axis direction of the process cartridge D and the untransferred residual toner 25*a* is locally accumulated on the one end side (a rear side) in FIG. 8(*b*) is considered. In this case, by providing the space 31*e* which is located downstream of the reinforcing portion 31*d* via which the untransferred residual toner 25*a* is moved from the drum 2 toward the inside of the cleaner container 20 and which extends in the drum rotational axis direction, the untransferred residual toner 25*a* can move in a direction indicated by an arrow Y (toward the other end side) in FIG. 8(*b*).

Figure 9:
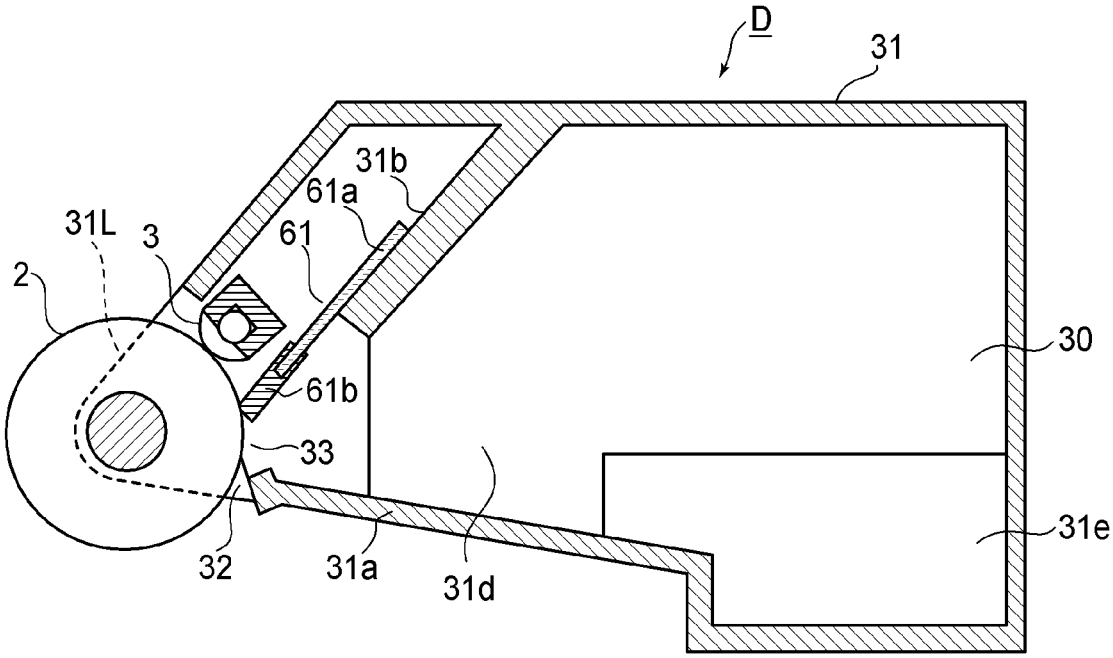
FIG. 9 is a schematic cross-sectional view of a first modified embodiment of the process cartridge.
Figure 10:
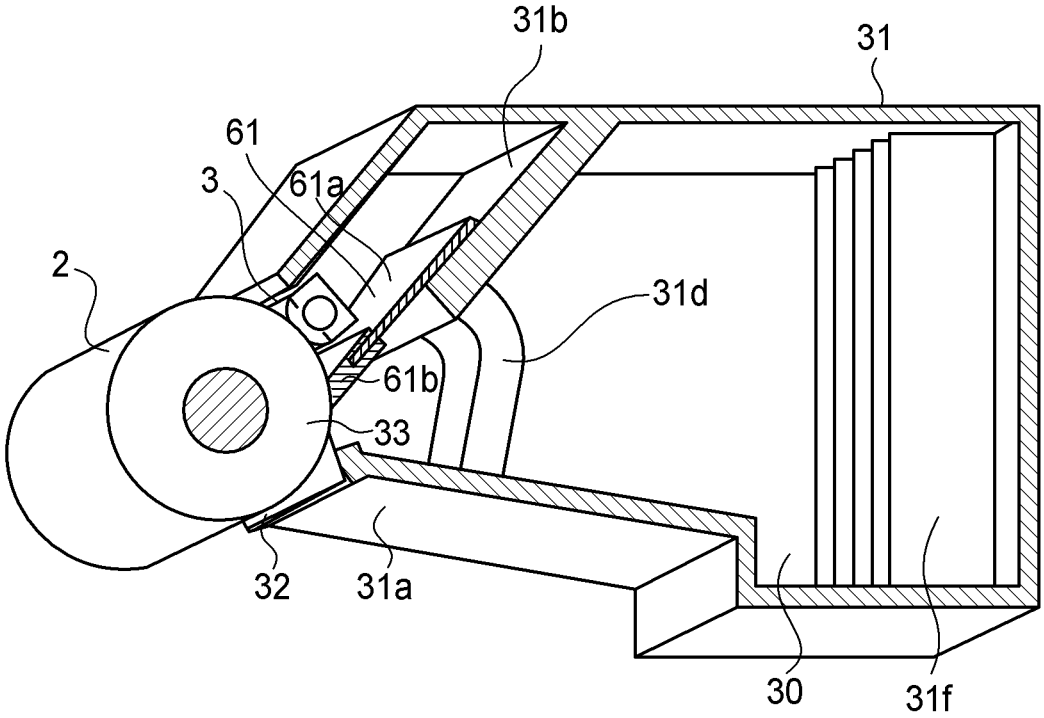
FIG. 10 is a schematic cross-sectional perspective view of a second modified embodiment of the process cartridge.

As described in this embodiment, in the case where the untransferred residual toner 25*a* is naturally accumulated with no forced feeding mechanism, the space 31*e* which is to be provided in the cleaning frame 31 and which extends in the drum rotational direction may desirably be provided at a portion at which the untransferred residual toner 25*a* accumulates. For example, as shown in FIG. 9, the reinforcing portion 21*d* is cut away and the space 31*e* extending in the drum rotational axis direction may also be provided on a downstream side on which the untransferred residual toner 25*a* is moved from the drum 2 toward the inside of the cleaner container 30. Further, the space 31*e* may only be required to extends from one end side to the other end side of the inside of the cleaning frame 31 and, e.g., as shown in FIG. 10, the cleaning frame 31 may also be provided with ribs 31*f* for enhancing strength thereof. Further, the cleaning frame 31 may be integrally molded or prepared by combining a plurality of frames.

The above-described constitution of the process cartridge D is summarized as follows. The process cartridge D includes at least the drum 2, the cleaning member 61 acting on the drum 2 to remove the untransferred residual developer, the cleaning frame 31 for accommodating the untransferred residual developer, and the flexible sheet member 32 contacting the drum 2. The process cartridge D is detachably mountable to the apparatus main assembly 1A of the image forming apparatus 1. The cleaning frame 31 includes the developer accommodating portion 30 for accommodating the untransferred residual developer 25*a*, the supporting portion 31*c* for supporting the flexible sheet member 32, and the opening 33 through which the untransferred residual developer 25*a* scraped off the drum 2 by the cleaning member 61 enters the developer accommodating portion 30. The cleaning frame 31 is provided with the reinforcing portion 31*d* connecting the one end-side portion 31*a* and the other end-side portion 31*b* which oppose to each other with respect to the opening 33. To the other end-side portion 31*b*, the supporting portion 32 for supporting the flexible sheet member 32. On the downstream side of the reinforcing portion 31*d*, on which the untransferred residual developer 25*a* is moved from the drum 2 toward the developer accommodating portion 30, the space 31*e* extending in the drum rotational axis direction (the image bearing member rotational axis direction) is provided.

The space 31*e* extending in the drum rotational axis direction is provided in the cleaning frame 31 of the process cartridge D on the downstream side, of the reinforcing portion 31*d*, on which the untransferred residual developer 25*a* is moved from the drum 2 toward the developer accommodating portion 30. For that reason, the untransferred residual developer accumulated in the cleaning frame 31 is movable in the drum rotational axis direction.

Incidentally, in this embodiment, the reinforcing portion 31*d* is a member connecting the one end-side portion 31*a* and the second supporting portion 31*b* for supporting the cleaning blade 61. However, the reinforcing portion may also be a downstream-side portion of the cleaning frame 31, with respect to the drum rotational direction a, other than the cleaning blade 61 supporting portion.

Embodiment 2

A constitution of an image forming apparatus in this embodiment is similar to that in Embodiment 1 but is different in structure of the cleaning device and the reinforcing portion in the cleaning frame.

Figure 11:
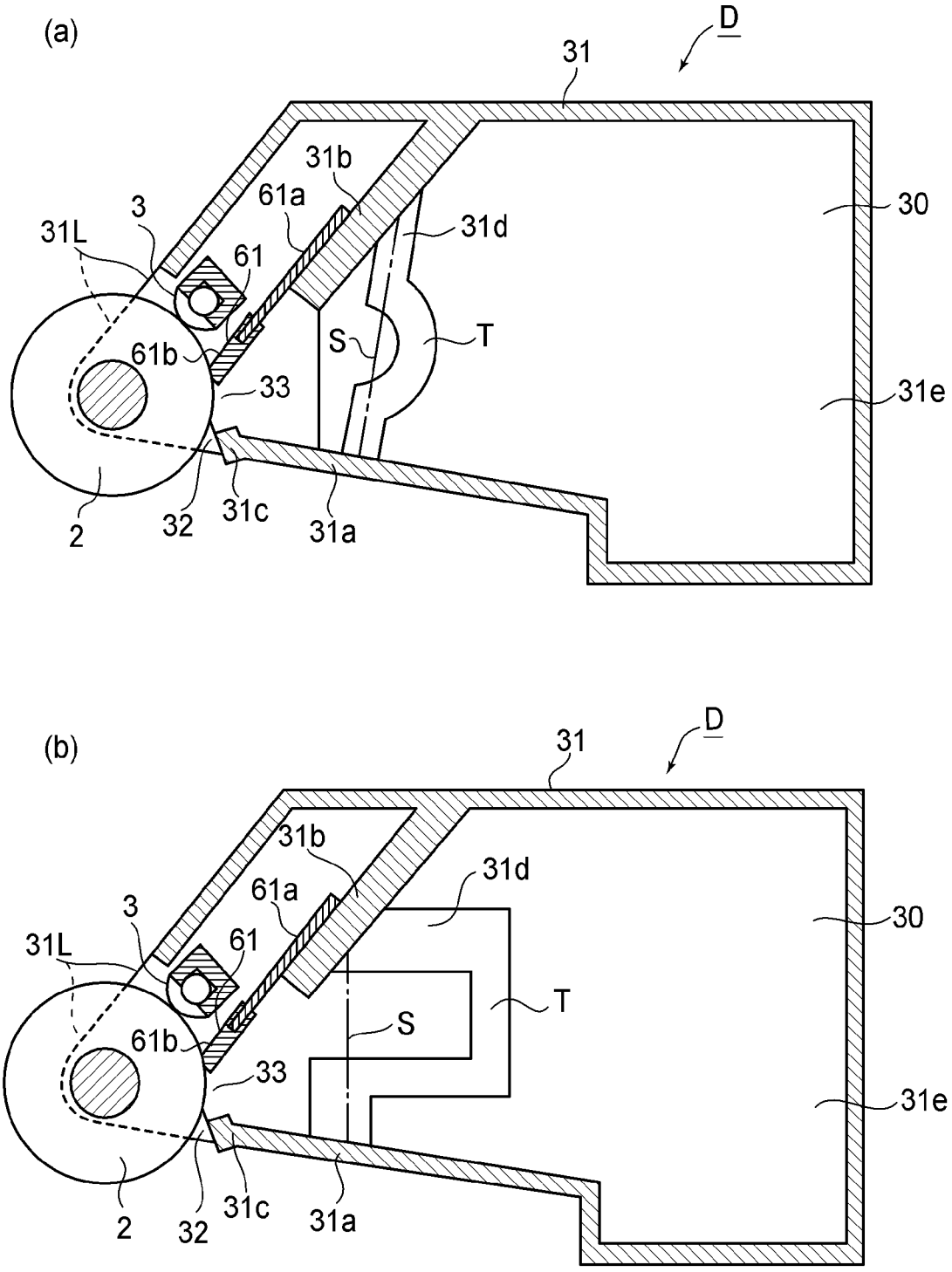
FIGS. 11(*a*) and 11(*b*) are schematic cross-sectional views each showing a process cartridge in Embodiment 2.

FIGS. 11(*a*) and 11(*b*) are schematic sectional views of the process cartridge D in this embodiment. In the process cartridge D in this embodiment, the reinforcing portion 31*d* connecting the one end-side portion 31*a* and the other end-side portion 31*b* at the opening 33 has a buffer portion T bent in a direction intersecting a straight line S connecting the one end-side portion 31*a* and the other end-side portion 31*b* opposing the one end-side portion 31*a*.

Even when the process cartridge D in this embodiment was left standing in a high-temperature environment and in a low-temperature environment, the untransferred residual developer accommodated in the cleaner container 30 was not leaked out. That is, the resin material-made cleaning frame 31 has a larger degree of thermal deformation than that of the cleaning blade 61 having the metal portion 61*a*, so that the cleaning frame 31 can partly cause the thermal deformation in the high-temperature environment or the low-temperature environment. On the other hand, the reinforcing portion 31*d* in this embodiment has the buffer portion T bent in the direction intersecting the straight line S connecting the one end-side portion 31*a* and the other end-side portion 31*b* opposing the one end-side portion 31*a* at the opening 33. Further, the buffer portion T is bent toward a side opposite, with respect to the straight line S, from a side on which the cleaning blade 61 is provided. For that reason, the thermal deformation of the other end-side portion 31*b* close to the opening 33 less influences the one end-side portion 31*a* close to the opening 33. That is, the buffer portion T of the reinforcing portion 31*d* close to the opening 33 absorbs the thermal deformation of the other end-side portion 31*b* close to the opening 33, thus performing a buffering function of suppressing the deformation of the one end-side portion 31*a* close to the opening 33. As a result, the deformation of the one end-side portion 31*a* close to the opening 33 is suppressed, so that waving of the flexible sheet member 32 contacting the drum 2 can be suppressed. The other end-side portion 31*b* opposing the one end-side portion 31*a* for supporting the flexible sheet member 32 contacting the drum 2 at the opening 33 supports the cleaning blade 61. However, the cleaning blade 61 containing the metal material and the cleaning frame 31 constituted by the resin material are different in thermal expansion coefficient. Therefore, in many cases, the other end-side portion 31*b* of the cleaning frame 31 supporting the cleaning blade 61 at the opening 33 has a degree of thermal deformation larger than that of the one end-side portion 31*a* close to the opening 33, so that the thermal deformation of the one end-side portion 31*a* close to the opening 33 is suppressed by the buffer portion T of the reinforcing portion 31*d*. As the shape of buffer portion T, it is suitably use a curved shape, a bent shape, a curvilinear shape, and the like. The formation direction of the buffer portion T may be only required to be such that the buffer portion T is bent in the direction intersecting the straight line S connecting the one end-side portion 31*a* and the other end-side portion 31*b* opposing the one end-side portion 31*a* at the opening 33 and, e.g., the buffer portion T may also be provided in the drum rotational axis direction.

In the process cartridge D in this embodiment, the reinforcing portion 31*d* has the buffer portion T bent in the direction intersecting the direction in which the one end-side portion 31*a* and the other end-side portion 31*b* opposing the one end-side portion 31*a* at the opening 33 are connected by the straight line. By employing this constitution, contact of the flexible sheet member 32 with the drum 2 can be stabilized even when a temperature change causing the thermal deformation of the cleaning frame 31 is caused.

Embodiment 3

Figure 12:
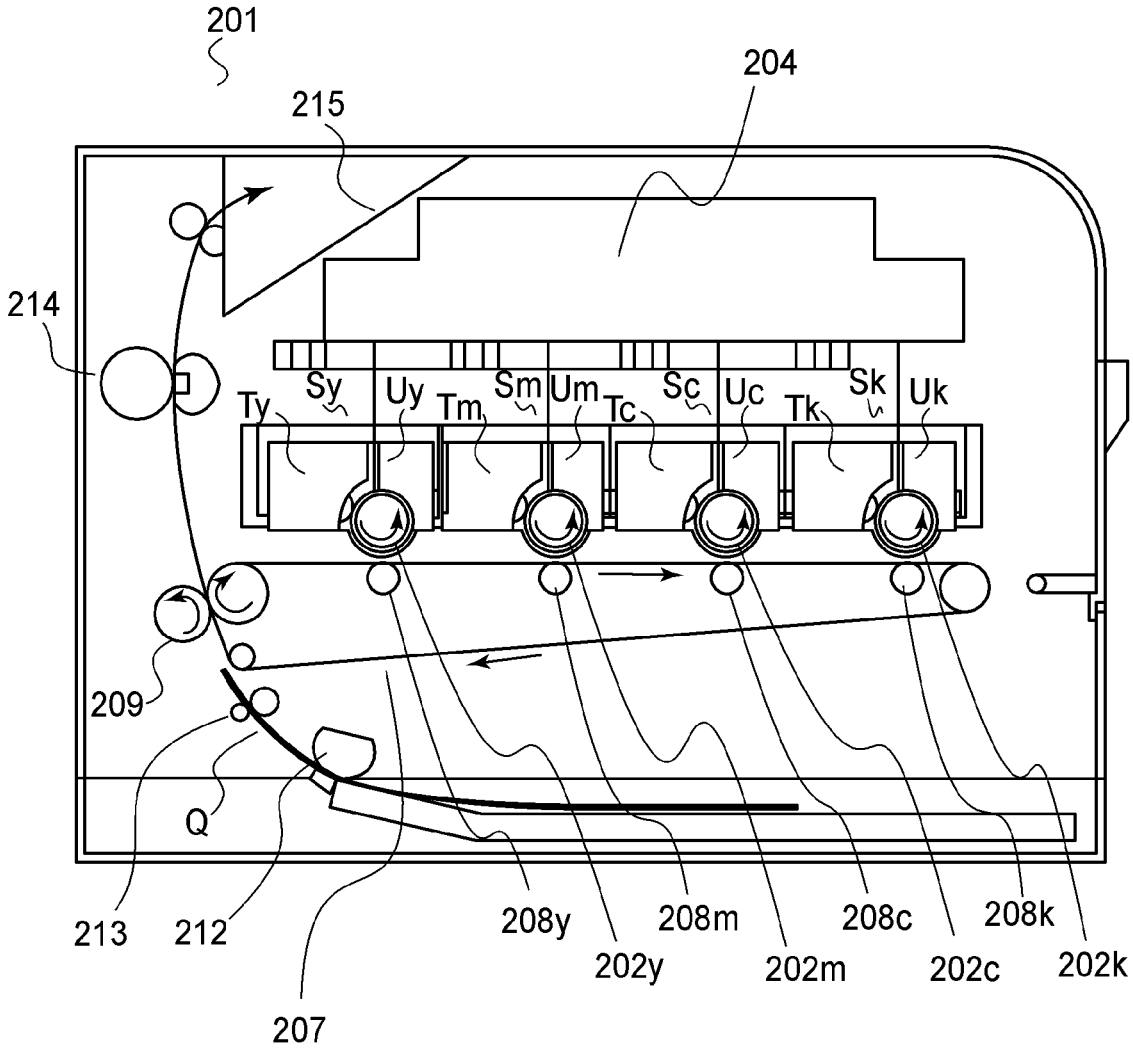
FIG. 12 is a schematic illustration of an image forming apparatus in Embodiment 3.
Figure 13:
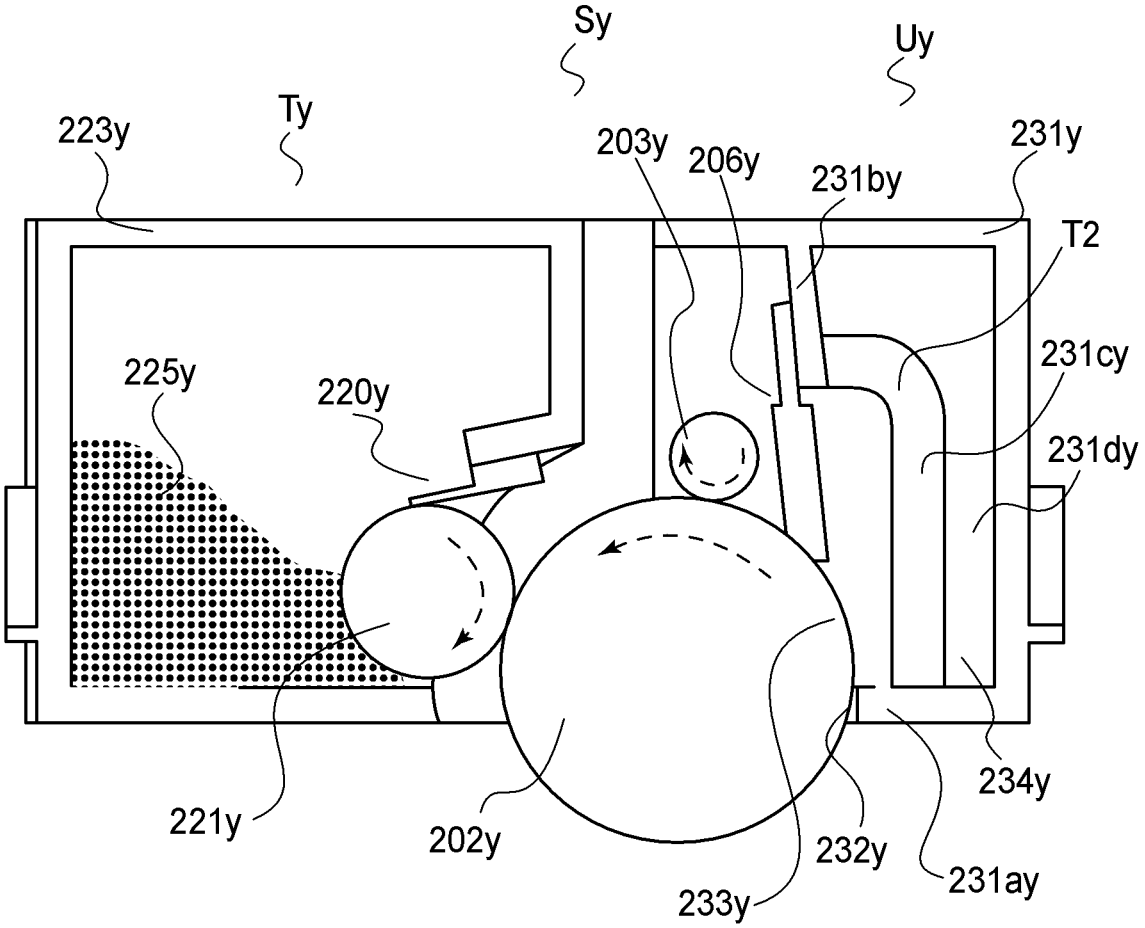
FIG. 13 is a schematic cross-sectional view of a process cartridge in Embodiment 3.

This embodiment is different from Embodiment 1 and Embodiment 2 in constitution of the image forming apparatus and the process cartridge. That is, the four color-based full-color image formation was effected in the image forming apparatuses in Embodiment 1 and Embodiment 2 by using the four developing devices and the single cleaning device. In this embodiment, a process cartridge including a pair of a developing device and a cleaning device is used. The image forming apparatus in this embodiment is an electrophotographic laser beam printer of a tandem (in-line) type in which a full-color image is formed by using process cartridges for four colors. FIG. 12 is a schematic sectional view showing a general structure of the image forming apparatus. FIG. 13 is a schematic view showing a general structure of a process cartridge suitably applicable to this embodiment.

<Image Forming Apparatus>

The image forming apparatus suitably applicable to this embodiment will be described with reference to FIG. 12. An image forming apparatus 201 includes a yellow process cartridge Sy, a magenta process cartridge Sm, a cyan process cartridge Sc, and a black process cartridge Sk. The yellow process cartridge Sy is constituted by a yellow developing unit Ty and a cleaning unit Uy. The magenta process cartridge Sm is constituted by a magenta developing unit Tm and a cleaning unit Um. The cyan process cartridge Sc is constituted by a cyan developing unit Tc and a cleaning unit Uc. The black process cartridge Sk is constituted by a black developing unit Tk and a cleaning unit Uk.

The surfaces of electrophotographic photosensitive drums 202*y*, 202*m*, 202*c*, and 202*k* as an image bearing member are electrically charged uniformly by associated charging rollers (not shown). Then, the surface of each of the drums 202*y*, 202*m*, 202*c*, and 202*k* of the process cartridges Sy, Sm, Sc and Sk is irradiated with laser light based on an image signal by an exposure device 204 to form an electrostatic latent image. The electrostatic latent images formed on the respective drums are developed and visualized by the developing units Ty, Tm, Tc and Tk. Thus, developer images are formed on the drums 202*y*, 202*m*, 202*c*, and 202*k* and thereafter a voltage of an opposite polarity to a charge polarity of the developers is applied to primary transfer rollers 208*y*, 208*m*, 208*c*, and 208*k*. As a result, the respective color developer images formed on the drums 202*y*, 202*m*, 202*c*, and 202*k* are successively transferred onto an intermediary transfer belt 207. Thereafter, the developer images transferred on the intermediary transfer belt 207 are transferred, by a secondary transfer roller 209, onto a recording material Q conveyed by a sheet feeding roller 212 as a feeding means and a registration roller pair 213. Thereafter, the recording material Q is conveyed to a fixing device 214 constituted by a driving roller, a fixing roller containing a heater, and the like. By the fixing device 214, heat and pressure are applied to the recording material Q, so that the developer images transferred on the recording material Q are fixed. Thereafter, the recording material Q on which the developer images are fixed is discharged on a sheet discharge portion which is an upper (top) cover 215 of the image forming apparatus.

<Process Cartridge>

Next, the process cartridges Sy, Sm, Sc, and Sk will be described with reference to FIG. 13. The process cartridges Sy, Sm, Sc and Sk have the same constitution expect that they contain developers different in color. For this reason, the following description will be made by using the process cartridge Sy.

The process cartridge Sy includes the drum 202*y* and process means acting on the drum 202*y*. The process means include a charging roller 203*y* as a charging means for electrically charging the drum 202*y*, a developing roller 221*y* as a developing means for developing the latent image formed on the drum 202*y*, a cleaning means 206*y* for removing an untransferred residual developer remaining on the surface of the drum 202*y*, and the like. The process cartridge Sy is divided into the developing unit Ty and the cleaning unit Uy.

<Developing Unit>

The developing unit Ty is, as shown in FIG. 13, constituted by the developing roller 221*y*, a developing blade 220*y* for regulating a layer thickness of the developer on a peripheral surface of the developing roller 221*y*, and a developing device frame 223*y*.

<Cleaning Unit>

As shown in FIG. 13, the cleaning unit Uy includes the drum 202, the charging roller 203*y* as the charging means, the cleaning means 206*y*, and a cleaning device frame 231*y*. The cleaning unit Uy further includes a flexible sheet member 232*y*, contacting the drum 202*y*, so as not to leak the untransferred residual developer accommodated in the cleaning unit Uy out of the cleaning unit.

The cleaning device frame 231*y* is provided with an opening 233*y* in the neighborhood of a contact portion between the drum 202*y* and the cleaning means 206*y*. Untransferred residual developer collected by the cleaning means 206*y* is accommodated in the cleaning unit Uy. The cleaning device frame 231*y* has a one end-side portion 231*ay*, for supporting the flexible sheet member 232*y* contacting the drum 202*y* at the opening 233*y*, provided so as not to leak the untransferred residual developer 234*y* accommodated in the cleaning unit Uy out of an untransferred residual developer container. Further, the other end-side portion 231*by* close to the opening 233*y* supports the cleaning means 206*y*. The one end-side portion 213*ay* and the other end-side portion 231*by* are connected by a reinforcing portion 231*cy*. By the presence of this reinforcing portion 231*cy*, e.g., even when the process cartridge Sy is gripped by the user during mounting and demounting of the process cartridge Sy, deformation of the cleaning device frame 231*y* is suppressed, so that it is possible to prevent the untransferred residual developer 234*y* from issuing from the inside of the cleaning device frame 231*y* due to internal pressure increase. Further, the cleaning device frame 231*y* is provided with a space 231*yd*, extending in the drum rotational axis direction, located downstream of the reinforcing portion 231*cy* via which the untransferred residual developer 234*y* is moved from the drum (image bearing member) 202*y* toward the developer accommodating portion. For that reason, the untransferred residual developer 234*y* accommodated in the cleaning unit Uy is movable in the drum rotational axis direction in the space 231*dy*. That is, even when printing is effected only on one end side on the surface of sheet (paper) and the untransferred residual developer 234*y* is accommodated locally only on one (end) side of the cleaning unit Uy, the untransferred residual developer 234*y* is movable toward the other (end) side with respect to the drum rotational axis direction by the presence of the space 231*dy* extending in the drum rotational axis direction. Further, the reinforcing portion 231*cy* has a buffer portion T bent in a direction intersecting a direction in which the one end-side portion 231*ay* and the other end-side portion 231*by* opposing the one end-side portion 231*ay* at the opening are connected by a straight line. For that reason, thermal deformation of the other end-side portion 231*by* less influences the one end-side portion 231*ay*, so that it is possible to suppress waving of the flexible sheet member 232*y* which is supported by the one end-side portion 231*ay* close to the opening and which contacts the drum 202*y*.

The process cartridge of the electrophotographic image forming apparatus is described above. However, the present invention is also applicable to process cartridges in an electrostatic recording image forming apparatus using an electrostatic recording dielectric member as the image bearing member and in a magnetic recording image forming apparatus using a magnetic recording magnetic member as the image bearing member.

According to the present invention, the deformation of the supporting portion for the sheet member for preventing the developer from leaking out of the developer accommodating portion is suppressed by the reinforcing portion, so that waving of the sheet member can be suppressed. Further, by providing the space extending the image bearing member rotational axis direction on the downstream side of the reinforcing portion, even when the image formation on the recording material is effected locally on one end side with respect to the axial direction of the image bearing member, the developer can move toward the other end side with respect to the axial direction in the developer accommodating developer.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 223402/2008 filed Sep. 1, 2008 and 165611/2009 filed Jul. 14, 2009, which are hereby incorporated by reference.

What is claimed is:

1. A process cartridge detachably mountable to a main assembly of an image forming apparatus, said process cartridge comprising:

an image bearing member;

a cleaning member for removing a developer from said image bearing member;

a frame provided with an opening;

a developer accommodating portion for accommodating the developer which was removed by said cleaning member and passed through the opening;

a sheet member, contacting said image bearing member, for preventing the developer from leaking out of said developer accommodating portion;

a supporting portion, provided to said frame, for supporting said sheet member; and a reinforcing portion, provided to said frame, connecting one end side portion of said frame located upstream of the opening with the other end side portion of said frame located downstream of the opening, with respect to a rotational direction of said image bearing member, wherein a space is provided downstream of said reinforcing portion with respect to a direction from the opening toward said developer accommodating portion, for permitting movement of the developer in an axial direction of said image bearing member, and wherein said reinforcing portion is provided with a buffer portion that is bent with respect to a straight line connecting with one end-side portion with the other end-side portion.

2. A cartridge according to claim 1, wherein said buffering portion is bent on an opposite side to a side on which said cleaning member is provided with respect to the straight line.

3. A cartridge according to claim 1, wherein said supporting portion is provided to the one end side portion.

4. A cartridge according to claim 1, wherein said frame includes a second supporting portion, provided to the other end side portion, for supporting said cleaning member.

5. A cartridge according to claim 1, wherein said buffer portion is formed by bending said reinforcing portion in both of its an upstream side and its downstream side with respect to the direction from the opening toward said developer accommodating portion.

6. A cartridge according to claim 1, wherein said frame is formed of a resin material, and wherein said cleaning member includes (i) a contacting member that contacts said image bearing member (ii) and a metal plate which supports said contacting member and which is mounted on said frame.

7. An image forming apparatus for forming an image on a recording material, said image forming apparatus comprising:

(i) mounting means;

(ii) a process cartridge detachably mountable to said mounting means, said process cartridge comprising:

(a) an image bearing member;

(b) a cleaning member for removing a developer from said image bearing member;

(c) a frame provided with an opening;

(d) a developer accommodating portion for accommodating the developer which was removed by said cleaning member and passed through the opening;

(e) a sheet member, contacting said image bearing member, for preventing the developer from leaking out of said developer accommodating portion;

(f) a supporting portion, provided to said frame, for supporting said sheet member; and (g) a reinforcing portion, provided to said frame, connecting one end side portion of said frame located upstream of the opening with the other end side portion of said frame located downstream of the opening, with respect to a rotational direction of said image bearing member, wherein a space is provided downstream of said reinforcing portion with respect to a direction from the opening toward said developer accommodating portion, for permitting movement of the developer in an axial direction of said image bearing member, and wherein said reinforcing portion is provided with a buffer portion that is bent with respect to a straight line connecting the one end-side portion with the other end-side portion; and (iii) conveying means for conveying the recording material.

8. An apparatus according to claim 7, wherein said buffering portion is bent on an opposite side to a side on which said cleaning member is provided with respect to the straight line.

9. An apparatus according to claim 7, wherein said supporting portion is provided to the one end side portion.

10. An apparatus according to claim 7, wherein said frame includes a second supporting portion, provided to the other end side portion, for supporting said cleaning member.

11. An apparatus according to claim 7, wherein said buffer portion is formed by bending said reinforcing portion in both of its an upstream side and its downstream side with respect to the direction from the opening toward said developer accommodating portion.

12. An apparatus according to claim 7, wherein said frame is formed of a resin material, and wherein said cleaning member includes (i) a contacting member contacting said image bearing member and (ii) a metal plate which supports said contacting member and which is mounted on said frame.

* * * * *